fluid operated lift jack means fixedly mounted to said cross-frame and having a cylinder portion extending from the bottom thereof, the center of gravity of said carriage assembly and said lift jack means is above said horizontal axis when said carriage assembly is in an upright operative position, roller means carried by said cross-frame below said lift jack means for engagement with said floor when said runways are in a lower position for swinging said cross-frame and said lift jack means into a folded-up generally horizontal position as said runways are lowered from an elevated position, stop means carried by said carriage assembly for limiting the swinging movement of said cross-frame as said runways are elevated, and second stop means carried by said carriage assembly and interacting between said cross-frame and at least one of said trolley wheel supports to prevent said cross-frame and said lift jack means from swinging into a position wherein said center of gravity would be below said horizontal axis.

2. The combination according to claim 1 wherein said roller means comprises a single wheel rotatable on a horizontal axle disposed below said lift jack means and having an external diameter greater than the width of said jack means to space said jack means from said floor when said cross-frame and said lift jack means are in the folded-up position.

3. The combination according to claim 1 comprising manually releasable safety means carried by said cross-frame for preventing the accidental lowering of said lift jack means, said safety means including a ratchet member pivotably mounted to said lift jack means and extending through an opening in said cross-frame, said ratchet member having ratchet teeth along one side thereof for operative engagement with one side of said opening, spring means interposed between said cross-frame and said ratchet member for urging said ratchet member and said ratchet teeth into engagement with said one side of said opening, a lever pivotably mounted to said cross-frame, and linkage means connected between said lever and said ratchet member for moving said ratchet member out of operative engagement with said one side of said opening to permit the lowering of said jack means in response to pivotal movment of said lever.

4. The combination according to claim 3 wherein said safety means comprises a second ratchet member pivotably mounted to said lift jack means and extending through a second opening in said cross-frame, said second ratchet member having ratchet teeth along one side thereof for operative engagement with one side of said second opening, and second linkage means connected between said lever and said second ratchet member for moving said second ratchet member out of operative engagement with said one side of said second opening in response to said pivotal movement of said lever, whereby actuation of said lever simultaneously releases both said ratchet members to permit the lowering of said lift jack means.

5. The combination according to claim 4 wherein said lift jack means comprises two spaced apart fluid operated cylinders, said ratchet members being outboard of said cylinders, and said lever being disposed between said cylinders.

6. The combination according to claim 5 wherein said cross-frame comprises a channel having a central web and depending said flanges, and said linkage means extends along the bottom side of said central web between said side flanges.

7. The combination according to claim 6 wherein said lift jack means comprises a lifting frame extending parallel to said cross-frame and disposed above said cross-frame when said carriage assembly is in an upright position, said ratchet members being pivotally mounted to said lifting frame.

8. The combination according to claim 7 wherein said spring means comprises, first and second leaf springs respectively mounted to said lift jack means and resiliently biased against said ratchet members to urge the teeth of said ratchet members into locking engagement with said one side of said openings in said cross-frame.

9. The combination according to claim 1 wherein said cross-frame comprises a channel member having a planar central web and depending side flanges, said pivot means comprises a single elongated bar affixed to the bottom of said cross-frame adjacent one of said side flanges and extending outwardly from the ends of said cross-frame, said stop means comprises first and second bars affixed to the bottom of said cross-frame adjacent the other of said side flanges and extending outwardly from the ends of said cross-frame, said trolley wheel support members each comprising a rigid member having a side flange extending along the adjacent end of said cross-frame, said single elongated bar being journaled in proximity to its respective ends in said rigid member, and each of said side flanges having a recess in its lower edge for receiving a respective one of said first and second bars when the plane of said central web is substantially horizontal.

10. The combination according to claim 9 wherein said trolley wheel support members respectively comprise an inverted channel having a web, said side flanges and a second side flange, each of said trolley wheels being disposed within one of the inverted channels and rotatably mounted to said side flange.

11. The combination according to claim 10 wherein said trolley wheels are mounted to said side flanges of said trolley wheel support members by means of elastomeric mounting means which permit said trolley wheels to retract into said support members under the load of a vehicle on said jack means, and brake surfaces carried by said support members for abutment with said rails when said trolley wheels retract into said support members.

12. In combination, a pair of spaced, mutually parallel runways for carrying a vehicle, power lift means for elevating and lowering said runways relative to a floor disposed below said runways,

ADJUSTABLE MOUNTING ARRANGEMENT FOR A ROTATABLE GUIDE MEMBER

DESCRIPTION

TECHNICAL FIELD

This invention relates to an adjustable mounting arrangement for a rotatable member and more particularly to an adjustable mounting arrangement for securing an eccentric roller assembly to a lift mast.

BACKGROUND ART

Lift mast assemblies frequently utilize rollers for guiding the mast uprights, carriage and lift chains for smooth low effort operation.

When used as a guide roller, for example side thrust or fore-aft, the roller must have an adjustment provision to enable proper radial positioning of the roller relative to the upright member against which it bears.

Frequently, the guide rollers are mounted on an eccentric shaft which is in turn connected to a shaft having an axis offset from the eccentric shaft axis. This shaft in turn is connected to the carriage, when used as a side thrust roller, and rotated relative to the carriage for radial adjustment purposes. An example of such a roller assembly is shown in U.S. Pat. No. 4,019,786 to William T. Yarris dated Apr. 26, 1977.

Typically, assemblies of this type are secured to a carriage support member, at a selected rotational position of the eccentric shaft and retained there in an assortment of different ways. U.S. Pat. No. 4,019,786 teaches the use of a threaded shaft, nut and washer for retention thereof, and U.S. Pat. No. 3,467,450 to H. K. Schmidt et al. dated Sept. 16, 1969 teaches the use of a pair of mating tapered surfaces and a threaded fastener for retention thereof.

These methods of retention have had only limited success since they rely on friction and clamping forces which are passive retention methods. When inadvertent loosening occurs improper adjustment results which reduces the efficiency of operation of the lift mast and ultimately results in premature wear of the roller, its associated componentry and damage to the lift mast.

Lift chains are utilized in lift masts to connect a moveable member, such as a carriage or moveable upright to a fixed upright and a lift jack. Usually the chain(s) is connected at one end to the fixed upright, trained over the sheave (roller) and connected at the other end to the moveable member. Typically, one end of the chain is connected by an adjustable member to provide adjustment of the chain tension. When a pair of chains are used equalization of the length and thus the tension is highly desirable to provide smooth, quiet and efficient operation. U.S. Pat. Nos. 4,280,592 to Richard J. Bartow dated July 28, 1981 and 4,238,004 to Harlan D. Olson dated Dec. 19, 1980 teach this type of chain arrangement.

Although this arrangement prevents tension adjustment, accessibility is often poor, inadvertent loosening frequent and accurate adjustment improbable due to friction between the rotatable sheave and the chain inhibiting sliding motion thereof.

Therefore, it would be advantageous to eliminate the adjustable device at the chain end connection and provide an adjustable sheave (roller) which would permit ease of chain tension adjustment throughout its full length and positive locking of the sheave to prevent inadvertent loosening.

DISCLOSURE OF INVENTION

In one aspect of the present invention, an adjustable mounting arrangement for a rotatable guide member of a lift mast assembly is provided wherein the guide member is rotatably mounted on an eccentric portion of a shaft having a cam member connected thereto. The cam member has a preselected shaped profile surface defining a plurality of incremental rotational cam positions which is matingly engageable by a member at one of the plurality of incremental rotational positions for retaining the shaft at that position from rotational and axial movement.

BEST MODE FOR CARRYING OUT THE INVENTION

Figure 1:
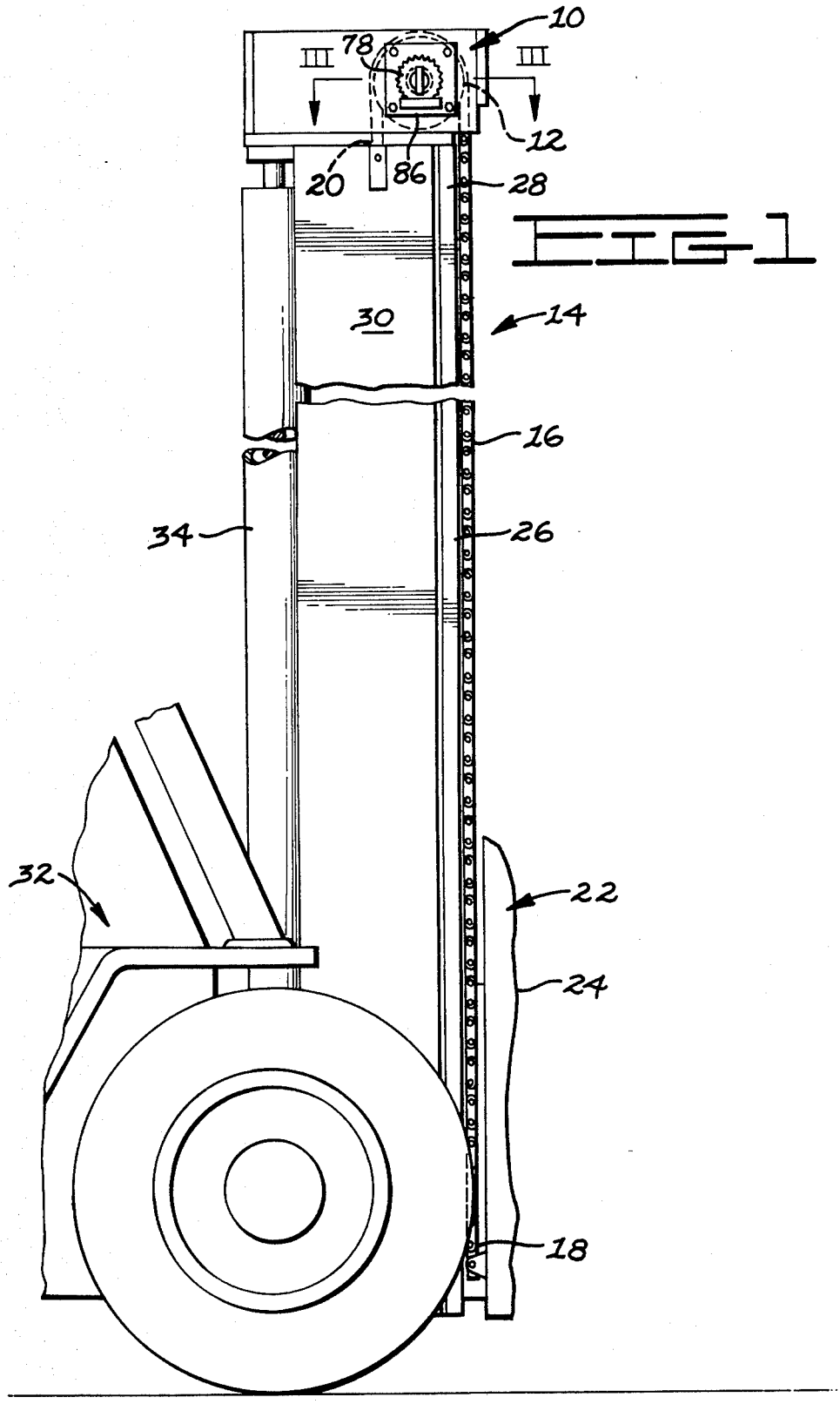
FIG. 1 is a diagrammatic side elevational view of a lift truck and lift mast assembly showing the adjustable mounting arrangement for a rotatable chain sheave.

Reference to the drawings and particularly the drawing of FIG. 1 a mounting arrangement 10 for adjustably connecting a rotatable guide member 12 to a lift mast assembly 14 is shown.

The rotatable guide member 12 is depicted as a guide sheave engageable with a flexible tension member 16, such as a chain, intermediate first and second chain ends 18 and 20 for elevationally moving flexible member 16 and a moveable member 22, such as a carriage or moveable upright, non-adjustably connected to the first end 18 of the chain 16. In the embodiment shown the moveable member is a load engaging carriage 24 mounted on a moveable upright 26 of the lift mast. The mounting arrangement 10 is also applicable for adjustably mounting other rotatable members, such as side thrust carriage or fore-aft upright rollers.

The adjustable mounting arrangement 10 connects the rotatable guide member 12 to the moveable upright 26 at an upper end portion 28 thereof. The moveable upright is mounted on a fixed upright 30 of the lift mast assembly which is mounted on a lift truck 32 and elevationally moveable relative to the fixed upright 30 in response to extension and retraction of a lift jack 34 connected thereto. It is to be noted that the rotatable guide member may be connected at other well known locations on a lift mast, such as the lift jack or fixed upright without departing from the spirit of the invention.

Figure 2:
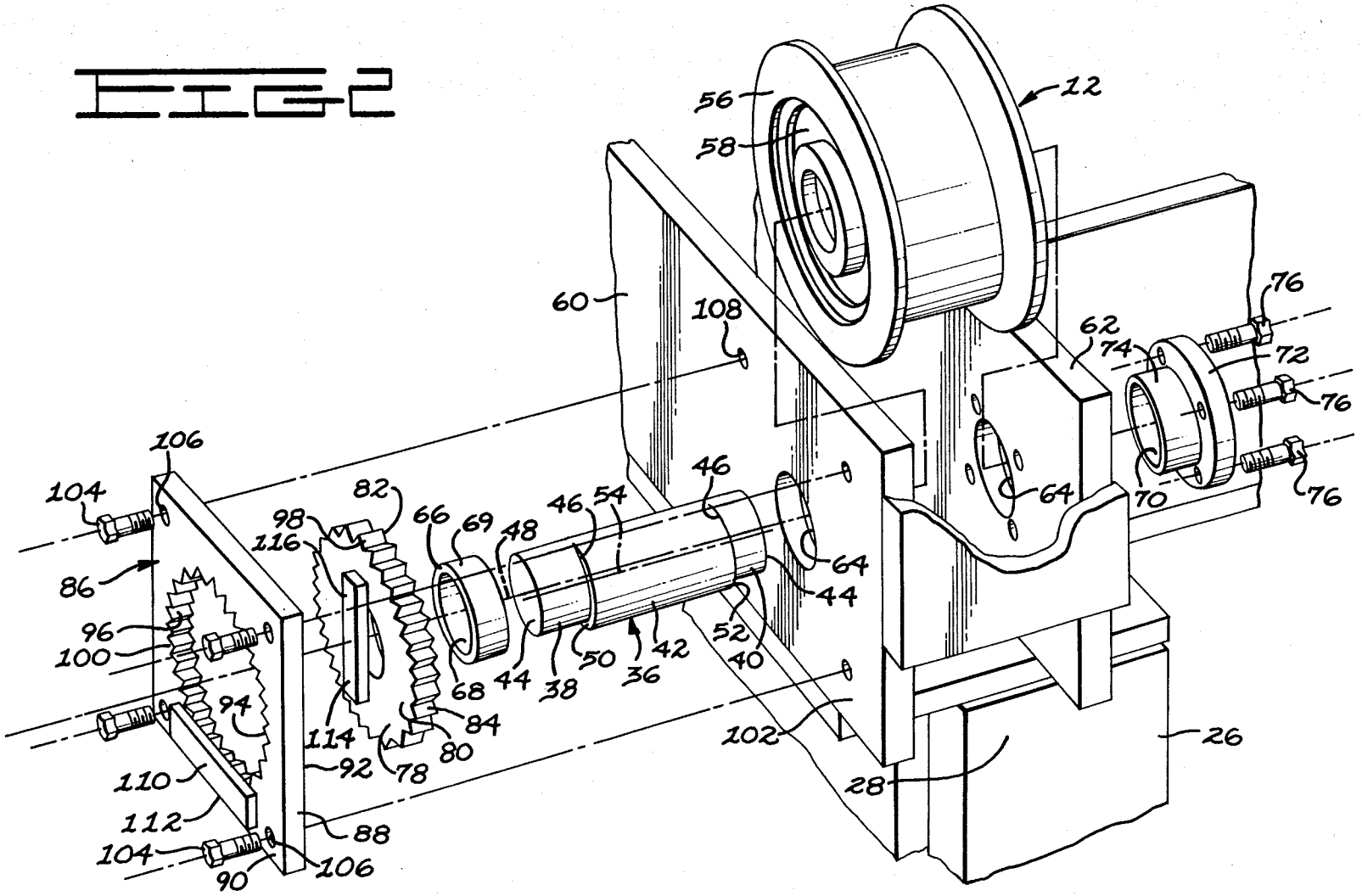
FIG. 2 is an exploded diagrammatic isometric view of the sheave and adjustable mounting arrangement of FIG. 1; and, FIG. 3 is a diagrammatic cross-sectional view taken along lines III—III of FIG. 1 showing the sheave and adjustable mounting arrangement in greater detail.
Figure 3:
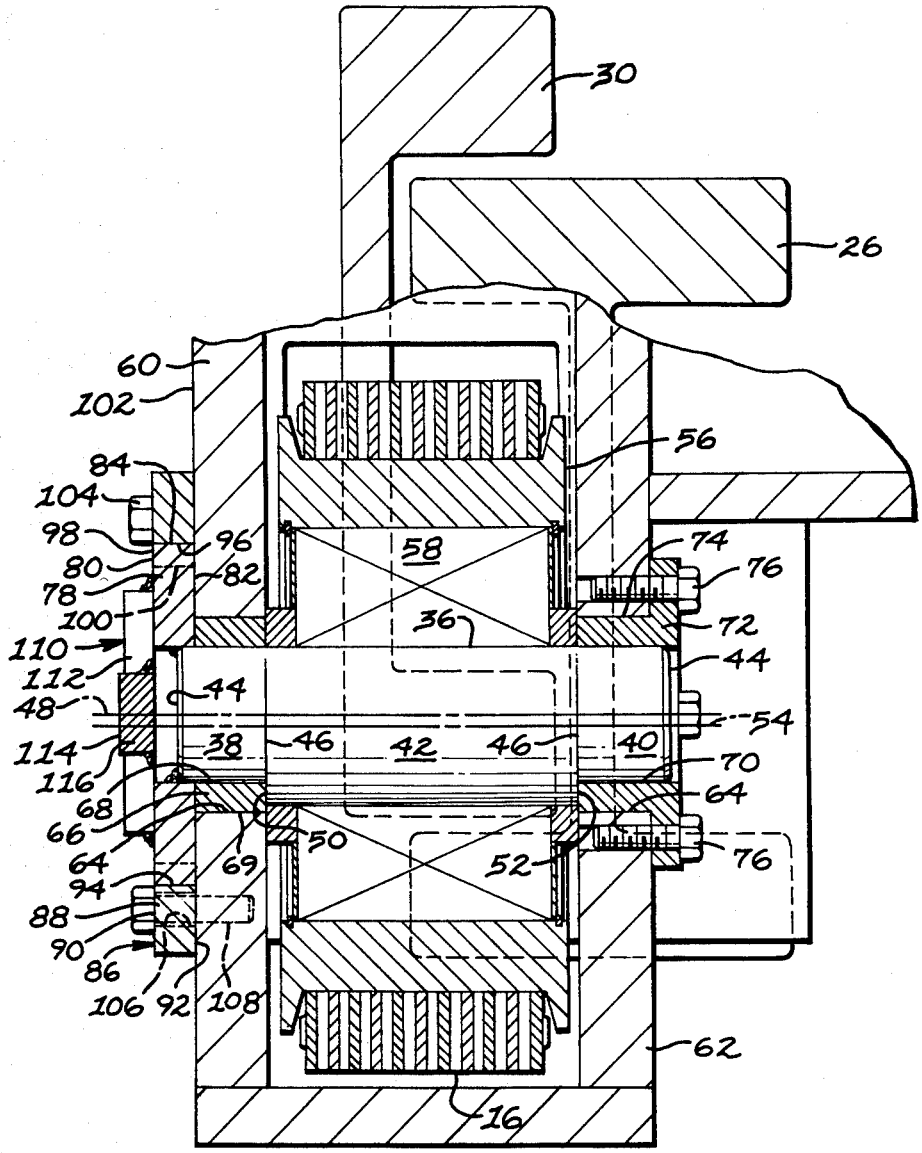

Referring to FIGS. 2 and 3, the adjustable mounting arrangement includes a shaft 36 having first and second cylindrical end portions 38 and 40 and a cylindrical eccentric portion 42. The first and second end portions 38 and 40 each have first and second ends 44 and 46 and a common central longitudinal axis 48. The eccentric portion 42 also has first and second ends 50 and 52 and a central longitudinal axis 54. The first end 50 of the eccentric portion 42 is connected to the second end 46 of the first end portion 38 and the second end 52 of the eccentric portion 42 is connected to the second end 46 of the second end portion 40. The longitudinal axis 54 of the eccentric portion 42 is spaced a preselected distance from and parallel to the longitudinal axis 48 of the first and second end portions 38 and 40. This spaced apart distance of the axes establishes the amount of radial adjustment provided to the rotatable member 12, i.e., the total amount of displacement of the rotatable member 12 will be equal to twice this distance.

The rotatable guide member 12 is mounted on the eccentric portion 42 of the shaft 36 and rotatable relative thereto. The rotatable member 12 has an outer cylindrical rim 56 supported for rotation on the shaft 36 by an anti-friction bearing 58. The first end portion 38 of shaft 36 is rotatably connected to a first support member 60 and the second end portion 40 is rotatably connected to a second support member 62. The first and second support members 60 and 62 are rectangular plates mounted vertically at the upper end portion 28 of the moveable upright 26. These support members 60 and 62 are spaced apart from one another, parallel to one another, and house the rotatable member therebetween.

Each of the support members have a bore 64 disposed therethrough. The bores 64 are axially aligned and of a size sufficient to pass the shaft 36 therethrough for installation and removal thereof. A first cylindrical sheave 66, having a bore 68 and an outer cylindrical surface 69, is removably disposed in the bore 64 of the first support member 60 with the outer cylindrical surface 69 in contact with the bore 64. The first end portion 38 of the shaft 36 is rotatably supported in the bore 68 of sheave 66. The second end portion 40 of shaft 36 is rotatably supported in a bore 70 disposed in a second cylindrical sheave 72. The second sheave 72 has an outer cylindrical surface 74 which is contactly disposed in the bore 64 of second support member 62. The sheave 74 is removably affixed to the second support member by a plurality of threaded fasteners 76.

A cam member 78 has first and second ends 80 and 82 and a preselected shaped profile surface 84. The second end 82 of the cam member 78 is securely mounted on the first end portion 38 of the shaft 36 adjacent the first end 44 thereof by welding or some other equivalent fastening technique. Thus, the cam 78 and shaft 36 rotate and translate axially together as a unitary piece. The profile surface 84 defines a plurality of incrementally spaced apart rotational cam positions thereabout. The profile surface 84 is engageable by mating member 86 when the profile surface 84 is at any one of the rotational cam positions.

The mating member 86 has a flange 88 which is preferably a rectangular shaped plate. The flange 88 has first and second sides 90 and 92 and a bore 94 defining a profile surface 96 of substantially the same shape as the profile surface 84 of said cam 78.

Specifically, the cam 78 has a preselected number of equally spaced apart teeth 98 of a preselected shape and size which extend radially outwardly from and circumferentially about the cam member 78 and relative to the longitudinal axis 48 of the first end portion 38.

Likewise, the flange 88 has a plurality of equally spaced apart teeth 100 which extend inwardly from the bore 94. The teeth of the flange 88 are of a size and shape and number to matingly slidingly fit in the spaces between the teeth 98 of the cross member 78. The number of teeth on the cam 78 and flange 88 determines the number of incremental rotational positions of the shaft 36. The greater the number of teeth on the cam the finer and more precise the rotational adjustment will be. It is to be noted that other shapes for the cam 78 and flange 88 profile surfaces may be used which should be considered equivalent replacements.

The flange 88 is removeably connected to a first side 102 of the first support member 60 by a plurality of threaded fasteners 104 disposed in holes 106 in the flange 88 and screw threadably engaged in taped holes 108 in the first support member 60. The flange is removeable so as to permit rotary motion of the shaft 36 and thus adjustment of the rotatable member 12.

A stop member 110 is connected to the flange member 88 and engageable with the first end 80 of the cam member 78. Preferably the stop member 110 is an elongated bar 112 connected to the first side of flange 88. The bar 112 passes over the bore 94 of the flange 88 so that it contacts the first end 80 of the cam member 78 when the shaft 36 is moved toward the bar 112.

As shown, the cam member 78 is sandwiched between the first side 102 of first support member 60 and the stop member 110 so that axial movement of the shaft 36 is prevented when the flange 88 is secured to the first support member 60 by fasteners 104. Specifically, the first end 80 of cam member 78 contacts stop member 110 and the second end 82 contacts the first side 102 of flange 88 which prevents axial movement in both axial directions. Also, the eccentric portion's second end 52 is contactable with the flange 74 which additionally prevents axial movement of the shaft 36 in a direction toward the flange 74. It should be noted that the second support member 62, flange 74, and second end portion 40 may be omitted from the mounting arrangement 10. In such a case the rotatable guide member 12 is mounted in a cantilevered fashion on the first support member. This type of mounting would be particularly useful when space is restricted such as when utilized in side thrust and fore-aft roller applications.

As previously indicated, the adjustable mounting arrangement 10 is particularly useful in lift chain guide sleeve applications. Such use will permit the chain 16 to be rigidly affixed at opposite ends 18 and 20 to selected members of the lift mast assembly 14 since adjustment of chain tension will be accomplished through selective positioning of the roller.

An extension 114 is provided for rotating the shaft 36 and then adjusting the rotating member 12. The extension 114 includes a rectangular shaped bar 116 affixed to the first end 80 of cam 78, such as by welding, and connectable by a wrench or the like. The bar 116 is preferably shorter in length than the diameter of the cam 78 and bore 94, and positioned on the cam at a location so that the axis 48 of the first end portion 38 passes through the bar 16 and the bar 116 extends past the first side 90 of flange 88.

In view of the foregoing, there is provided a mounting arrangement of simple construction for adjustably connecting a rotatable member to a lift mast assembly and positively retaining the rotatable member at a preselected adjustable position.

Industrial Applicability

To adjust the position of the rotatable member 12, mating member 86 must be displaced from engagement with cam member 78 so that shaft 36 is free to rotate about its end portions 38 and 40.

The fasteners 104 are either removed or loosened a preselected amount so that the flange 88 is moveable from a second position, at which the flange 88 is in contact with the first side 102 of the first support member and the teeth 98 of the cam member 78 are engaged with the teeth 100 of the flange 88, to at least a first position at which the flange 88 is spaced from the first side 102 and the teeth 98 are disengaged from teeth 100.

Upon movement of the flange 88 to the first position the shaft 36 is freed for rotation. A wrench or the like is then attached to the rectangular shaped bar 116 to rotate the shaft 36 about its end portions 38 and 40 and longitudinal axis 48. The shaft is then rotated a desired amount until the rotatable member 12 is properly positioned.

In the embodiment shown the proper position would be determined by the amount of tension or slack in the chain 16 desired. When two chains are utilized, the shaft 36 of each rotatable guide member is rotated until the amount of tension or slack in both chains are equal.

Upon completion of the adjustment, the flange 88 is moved into contact with the surface 102 of support member 60, with the teeth 100 of the flange 88 in mating engagement with the teeth 98 of cam member 78. The fasteners 104 are then firmly secured to retain the flange 88 securely against surface 102. It should be observed that the shaft 36 must be rotated an amount great enough to advance or retard the teeth 98 of the cam member 78 at least one tooth position relative to the flange 88 and teeth 100 to provide any change in the position of the shaft 36 and thus the rotatable member. Therefore, an adequate number of teeth 98 and 100 are provided to facilitate precise enough adjustment.

During operation of the lift mast assembly, vibratory, impact and cyclical loading is present at the rotatable guide roller 12. This loading, under normal conditions, causes loosening of the roller supporting shaft which results in premature failure as previously discussed. This mounting arrangement 10, as described herein, alleviates this problem by positively retaining the shaft 36 from axial and rotational motion. All axial forces on the shaft 31 are directed to the support member via cam member 78 either directly or through stop member 10 and flange 88. Rotational forces and vibration acting on the shaft 36 are resisted through the positive tooth connections between the support member 60, mounted flange 88 and cam 78.

Also, the use of this radially adjustable guide roller for adjusting the tension of the lift chain permits opposite chain ends 18,20 to be secured to the moveable member 22 and fixed member 30, respectively, without providing any adjustment at either or both of the ends. As a result the chain tension adjustment will be quick, easy, and accurate.

Other aspects, objects and advantages of the invention can be obtained from a study of the drawings, disclosure, and appended claims.

We claim:

1. An adjustable mounting arrangement (10) for a rotatable guide member (12) of a lift mast assembly (14), comprising:

a shaft (36) having a first cylindrical end portion (38) and a cylindrical eccentric portion (42), said first end portion (38) having first and second ends (44,46) and a longitudinal axis (48), and said eccentric portion (42) having first and second ends (50,52) and a central longitudinal axis (54), said eccentric portion first end (50) being connected to the second end (46) of the first end portion (38), and said longitudinal axis (54) of the eccentric portion (42) being offset relative to the longitudinal axis (48) of the first end portion (38), said rotatable guide member (12) being mounted on said eccentric portion (42) and rotatable about said central longitudinal axis (54);

a first support member (60), said shaft first end portion (38) being connected to and axially and rotatably movable relative to the first support member (60);

a cam member (78) having a preselected shaped cam profile surface (84) and being mounted on said shaft first end portion (38), said cam member (78) being axially movable and rotatable with said shaft (36), said cam profile surface (84) being radially spaced from and circumferentially disposed about the longitudinal axis (48) of said shaft first end portion (38) and defining a plurality of incrementally rotational cam positions;

means (86) for engaging said cam profile surface (84) at a selected one of said plurality of incrementally rotational cam positions and positively maintaining said shaft (36) at said selected one position from rotational and axial movement;

said engaging means (86) includes a flange (88) having a bore (94) and being connected to said first support member (60), said bore (94) defining a profile surface (96) of substantially the same configuration as the cam profile surface (84), said cam member (78) being slidably disposed in said flange bore (94) and said cam profile surface (84) being contactably engaged with said bore profile surface (96);

said flange (88) being movable between a first position, at which said flange (88) is spaced from said first support member (60) and said cam member (78) is free from contacting said bore profile surface (96), and a second position, at which said flange (88) is contactable with said first support member (60) and said cam member (78) is contactable with said bore profile surface (96).

2. The adjustable mounting arrangement (10), as set forth in claim 1, wherein said cam profile surface (84) includes a plurality of equally spaced apart teeth (98), extending radially outwardly from said cam member (78) and relative to the axis (48) of said shaft first end portion (38), said bore profile surface (96) defines a plurality of equally spaced apart teeth (100) extending radially inwardly from said bore (94) and towards the axis (48) of said shaft first end portion (38), said flange teeth (100) being matingly engageable with said cam teeth (98).

3. The adjustable mounting arrangement (10), as set forth in claim 2, wherein said lift mast assembly includes a flexible tension member (16), said flexible tension member being trained over said rotatable guide member (12) and contactably guided thereby.

4. The adjustable mounting arrangement (10), as set forth in claim 1, wherein said engaging means (86) includes:

fastening means (104,106,108) for releasably connecting said flange member (88) to said first support member (60) at the second position of said flange member (88).

5. The adjustable mounting arrangement (10), as set forth in claim 4, wherein said fastening means (104,106,108) includes:

a plurality of threaded fasteners (104) each being disposed in an aperture (106) in said flange (88) and connected to said first support member (60).

6. An adjustable mounting arrangement (10) for a rotatable guide member (12) of a lift mast assembly (14), comprising:

a shaft (36) having a first cylindrical end portion (38) and a cylindrical eccentric portion (42), said first end portion (38) having first and second ends (44,46) and a longitudinal axis (48), and said eccentric portion (42) having first and second ends (50,52) and a central longitudinal axis (54), said eccentric portion first end (50) being connected to the second end (46) of the first end portion (38), and said longitudinal axis (54) of the eccentric portion (42) being offsetg relative to the longitudinal axis (48) of the first end portion (38), said rotatable guide member (12) being mounted on said eccentric portion (42) and rotatable about said central longitudinal axis (54);

a first support member (60), said shaft first end portion (38) being connected to and axially and rotatably movable relative to the first support member (60);

a cam member (78) having a preselected shaped cam profile surface (84), a first end (80), and being mounted on said shaft first end portion (38), said cam member (78) being axially movable and rotatable with said shaft (36), said cam profile surface (84) being radially spaced from and circumferentially disposed about the longitudinal axis (48) of said shaft first end portion (38) and defining a plurality of incrementally rotational cam positions;

means (86) for engaging said cam profile surface (84) at a selected one of said plurality of incrementally rotational cam positions and positively maintaining said shaft (36) at said selected one position from rotational and axial movement;

said engaging means (86) includes a flange (88) and a stop member (110), said flange (88) having a bore (94) and being connected to the first support member (60), and said stop member (110) being connected to said flange member (88), said bore (94) defining a profile surface (96) of substantially the same shape as the cam profile surface (84), said cam member (78) being slidably disposed in said flange bore (94), said stop member (110) being engageable with the first end (80) of said cam member (78) and said cam profile surface (84) being contactably engaged with said bore profile surface (96).

7. The adjustable mounting arrangement (10), as set forth in claim 6, wherein said flange member (88) has a side (90) and said stop member (110) is an elongted bar (112), said elongated bar (112) being connected to said flange side (90) and in an overlapping relationship with said bore (94).

8. The adjustable mounting arrangement (10), as set forth in claim 6, wherein said cam member (78) has a second end (82) and said first support member (60) has a first side (102) and a bore (64) disposed therethrough, said shaft first end portion (38) being rotatably supportingly disposed in said bore (64) and said cam member (78) being located between the first side (102) of said first support member (60) and said stop member (110), said cam member second end (82) being contactably engaged with the first side (102) of said first support member (60).

9. The adjustable mounting arrangement (10), as set forth in claim 8, wherein said shaft (36) has a cylindrical second end portion (40) axially aligned with the first end portion and connected to the second end (52) of said eccentric portion (42) and including:

a second support member (62) having a bore (64) disposed therein, said shaft second end portion (40) being rotatably supportingly disposed in the bore (64) of said second support member (62), and said eccentric portion (42) being located between said first and second support members (60,62).

10. The adjustable mounting arrangement (10), as set forth in claim 9, including:

first and second sleeve members (66,72) each having a cylindrical bore (68,70) and an outer cylindrical surface (69,74), said first sleeve (66) being disposed in the bore (64) of the first support member (60) and said second sleeve (72) being disposed in the bore (64) of said second support member (62), said shaft first end portion (38) being disposed in the bore (66) of said first sleeve (66) and rotatable relative thereto and, said shaft second end portion (40) being disposed in the bore (70) of said second sleeve (72) and rotatable relative thereto.

11. The adjustable mounting arrangement (10), as set forth in claim 8, wherein the bore (64) of said first support member (60) is of a size sufficient to pass the eccentric portion (42) of said shaft (36) therethrough.

12. The adjustable mounting arrangement (10), as set forth in claim 6, including:

means (114) for rotating said shaft (36) about the longitudinal axis (48) of said first end portion (38) and positioning said cam surface (84) at a selected one of said incremental rotational positions.

13. The adjustable mounting arrangement (10), as set forth in claim 12, wherein said rotating means (114) includes:

a rectangular shaped bar (116) connected to the first end (80) of said cam member (78).

14. In a lift mast assembly (14), having a fixed member (30) and an elevationally movable member (22), a rotatable sheave (12) and a flexible tension member (16) having opposite ends (18,20), said flexible member (16) being trained over said sheave (12) and connected at one end (20) to the fixed member (30) and at the other end (18) to the movable member (22), the improvement comprising:

a shaft (36) having a cylindrical first and second end portion (38,40) and a cylindrical eccentric portion (42), said first and second end portions (38,40) having a common central longitudinal axis (48) and said eccentric portion (42) having a central longitudinal axis (54), said eccentric portion longitudinal axis (54) being parallel to and spaced from the longitudinal axis (48) of said end portions (38,40), said sheave (12) being rotatably mounted on said eccentric portion (42);

first and second support members (60,62), said support members (60,62) being connected to said movable member (22) and said first and second shaft end portions (38,40) being rotatably connected to said first and second support members (60,62), respectively;

a cam member (78) having a plurality of spaced apart teeth (98) and being connected to the first end portion (38) of said shaft (36), each of said teeth defining an incremental rotational shaft position; and, means (86) for matingly engaging the teeth (98) of said cam member (78) at a selected one of said incremental rotational positions of said shaft (36)

and retaining said cam member (78) and said shaft (36) from rotational and axial movement, said engaging means (86) includes;

a flange (88) having a bore (94), a side (90) and a plurality of spaced apart teeth (100) projecting inwardly from said bore (94), said flange (88) being removably connected to said first support member (60), and a stop (110) connected to the side (90) of said flange (88) and passing said bore (94) in an overlapping fashion, said stop (110) being engageable with said cam member (78).

15. The lift mast assembly (14), as set forth in claim 14, including:

means (114) for rotating said shaft (36) about the first and second end portion longitudinal axis (48) and positioning said cam member (78) at a selected location at which the teeth (98) of the cam member (78) and the flange (88) are aligned for mating engagement.

16. The lift mast assembly (14), as set forth in claim 15, wherein said cam member (78) has a first end (80) and said rotating means (114) includes:

a bar (116) having a rectangular shape and being connected to the first end (80) of said cam member (78).

17. The lift mast assembly (14), as set forth in claim 14, wherein said flexible tension member (16) is adjustably movable relative to the ends (18,20) of the chain in response to rotation of said shaft (36).

18. An adjustable mounting arrangement (10) for a rotatable guide member (12), comprising:

a lift mast assembly (14);

a shaft (36) having a first cylindrical end portion (38) and a cylindrical eccentric portion (42), said first end portion having a longitudinal axis (48) and said eccentric portion having a central longitudinal axis (54), said central longitudinal axis (54) being offset from said longitudinal axis (48);

a first support member (60) slidably and rotatably connecting said shaft first end portion (38) to said lift mast assembly (14);

a cam member (78) having a preselected shaped cam profile surface and being fixedly connected to the shaft first end portion (38), said cam profile surface (84) being radially spaced from the longitudinal axis (48) and circumferentially disposed about the shaft first end portion (38);

a flange (88) having a bore (94) and being connectable to the first support member (60), said bore having a profile surface (96) of substantially the same configuration as the cam profile surface (84);

a stop member (110) connected to said flange (88), said flange (88) being movable between a first position at which said stop member (110) is engaged with said cam member (78) and said cam profile surface (84) is engaged with said bore profile surface (96), and a second position at which said stop member (110) is free from engagement with said cam member (78) and said cam profile surface (84) is free from engaging said bore profile surface (96); and means (104) for releasably connecting said flange (88) to said first support member (60).

* * * * *